United States Patent [19]

Isozumi

[11] Patent Number: 5,035,151

[45] Date of Patent: Jul. 30, 1991

[54] ENGINE STARTER MOTOR

[75] Inventor: Shuzoo Isozumi, Himeji, Japan

[73] Assignee: Mitsubishi Denki Kabushiki Kaisha, Tokyo, Japan

[21] Appl. No.: 413,511

[22] Filed: Sep. 27, 1989

[30] Foreign Application Priority Data

Sep. 27, 1988 [JP] Japan ..... 63-243114

[51] Int. Cl.[5] ..... F02N 15/06

[52] U.S. Cl. ..... 74/7 A; 74/6; 74/7 R

[58] Field of Search ..... 74/6, 7 R, 7 A, 7 E, 74/8

[56] References Cited

U.S. PATENT DOCUMENTS

| | | | |
|---|---|---|---|
| 1,679,602 | 8/1928 | Chilton | 74/6 X |
| 2,593,933 | 4/1952 | Strawn | 74/8 |
| 2,759,364 | 8/1956 | Lewis | 74/6 |
| 2,786,358 | 3/1957 | Dethmers et al. | 74/6 |
| 3,176,525 | 4/1965 | Rose | 74/7 R |
| 4,304,140 | 12/1981 | Ebihara | 74/7 A X |
| 4,404,533 | 8/1983 | Kurihara et al. | 335/131 |

*Primary Examiner*—Allan D. Herrmann

*Attorney, Agent, or Firm*—Sughrue, Mion, Zinn, Macpeak and Seas

[57] ABSTRACT

A starter motor having a pinion engageable with a ring gear of an engine to start the engine by the motor. The pinion of the starter motor is the over-hang type which is over-hanging relative to a front housing, and the number of teeth of the pinion is seven.

2 Claims, 4 Drawing Sheets

ENGINE STARTER MOTOR

BACKGROUND OF THE INVENTION

This invention relates to an engine starter motor and more particularly to a vehicular starter motor.

FIG. 5 is a sectional view of a clutch arrangement of a conventional engine starter motor. In FIG. 5, 2 is a plunger, 3 is a shift lever rotatable about a fulcrum 3*a* and engaged at its upper end with the plunger 2 and at its lower end with the rear end of an over-running clutch unit 4. Reference numeral 5 is an electric motor, 6 is an armature and 7 is a field coil for generating a magnetic field in the armature 6. Reference numeral 8 is an output rotary shaft extending from the rotary shaft 6*a* of the armature 6, and a clutch outer member 4*a* of the over-running clutch unit 4 is in engagement with helical splines 8*a* formed in the outer circumference of the rotary shaft 8. Reference numeral 9 is a pinion capable of engaging a ring gear of an unillustrated engine and is integral with the clutch inner member 4*b*. 10 is a bearing for supporting the pinion 9 on the output shaft 8. 11 is a stopper mounted at the front end portion of the output rotary shaft 8 by a ring 11*a*, and the front end of the pinion 9 abuts against this stopper 11. 12 is a front housing, and 13 is a bearing mounted to the front housing 12 for supporting the front end of the output rotary shaft 8. 14 is a washer for receiving a thrust force of the output rotary shaft 8. Reference numeral 2*a* is a spring for providing a pushing force to the pinion 9 when it is to be engaged with the ring gear.

The operation will now be described. When a key switch (not shown) is turned on, the excitation coil of the solenoid switch 1 is energized to attract the plunger 2 rearwardly (to the left). This causes the upper end of the lever 3 engaged with the plunger 2 to be pulled leftward in the figure and the lower end of the lever 3 to be moved rightward about the fulcrum 3*a*, thus causing the pinion 9 together with the over-running clutch unit 4 to slide along the output rotatable shaft 8 to bring it into engagement with the engine ring gear (not shown). On the other hand, at the same time as the above operation, since the solenoid switch is closed, the electric motor 5 is energized to rotate the armature 6. This rotation of the armature is transmitted from the rotary shaft 6*a* to the pinion 9 through the helical splines 8*a* and the over-running clutch unit 4, thereby rotating the engine ring gear to start the engine.

While the conventional engine starter motor is constructed as above described, a reduction of the size of the starter motor is desired in the circumstances that the number of auxiliary equipments around the vehicular engine is increased and the fuel comsumption rate should be decreased. One measure for reducing the size of the starter motor is an increased gear ratio between the pinion 9 and the ring gear, because the starter motor can be made light-weight by selecting a larger gear ratio. The gear ratio can be increased either by increasing the number of teeth the engine ring gear or by decreasing the number of teeth of the pinion.

However, increasing the number of teeth of the engine ring gear is difficult because this means an increased diameter of the engine ring gear which in turn causes the diameter of the engine transmission to be large, thus making the engine compartment of the vehicle large.

Also, decreasing the number of teeth of the pinion is not practical for the following reasons. In the conventional engine starter motor, the output rotary shaft 8 is located inside of the pinion 9, and in view of the mechanical strength of the output rotary shaft 8, the strength of the dedendum of the teeth of the pinion, and of the reduction of the impact and wear of the pinion by making the engagement ratio between the pinion and the ring gear as large as possible, the number of teeth of the pinion cannot be decreased as much as desired. More particularly, the Module (pitch divided by pi) of the pinion is equal to or less than 2.75 and generally a pinion for an ordinary automobile has a Module of 2.54. The minimum number of teeth of such a pinion is eight, and if the number of teeth is decreased to less than eight, the contact ratio between the pinion and the ring gear is decreased, resulting in a large impact applied to various parts of the stater motor and the engine ring gear and a large pinion wear. Providing sufficient mechanical strength is thus difficult, making such thus the pinion impractical.

SUMMARY OF THE INVENTION

Accordingly, one object of the present invention is to provide an engine starter free from the above discussed disadvantages of the conventional engine starter.

Another object of the present invention is to provide an engine starter having a smaller and lighter electric motor.

Another object of the present invention is to provide an engine starter having a smaller and lighter solenoid switch.

A further object of the present invention is to provide an engine starter having a small and light electric motor and a small and light solenoid switch.

With the above objects in view, the engine starter motor of the present invention has a pinion engageable with a ring gear of an engine to start the engine by the motor, and the pinion of the starter motor is of the over-hang type which is over-hanging relative to a front housing, and the number of teeth of the pinion is seven.

According to the present invention, since the number of teeth of the pinion of the starter motor of the over-hang type is seven, the gear ratio between the pinion and the engine ring gear is increased, enabling the motor unit to be compact and light-weight.

BRIEF DESCRIPTION OF THE DRAWINGS

The present invention will become more readily apparent from the following detailed description of the preferred embodiments of the present invention taken in conjunction with the accompanying drainings, in which.

DESCRIPTION OF THE PREFERRED EMBODIMENTS

Figure 1:
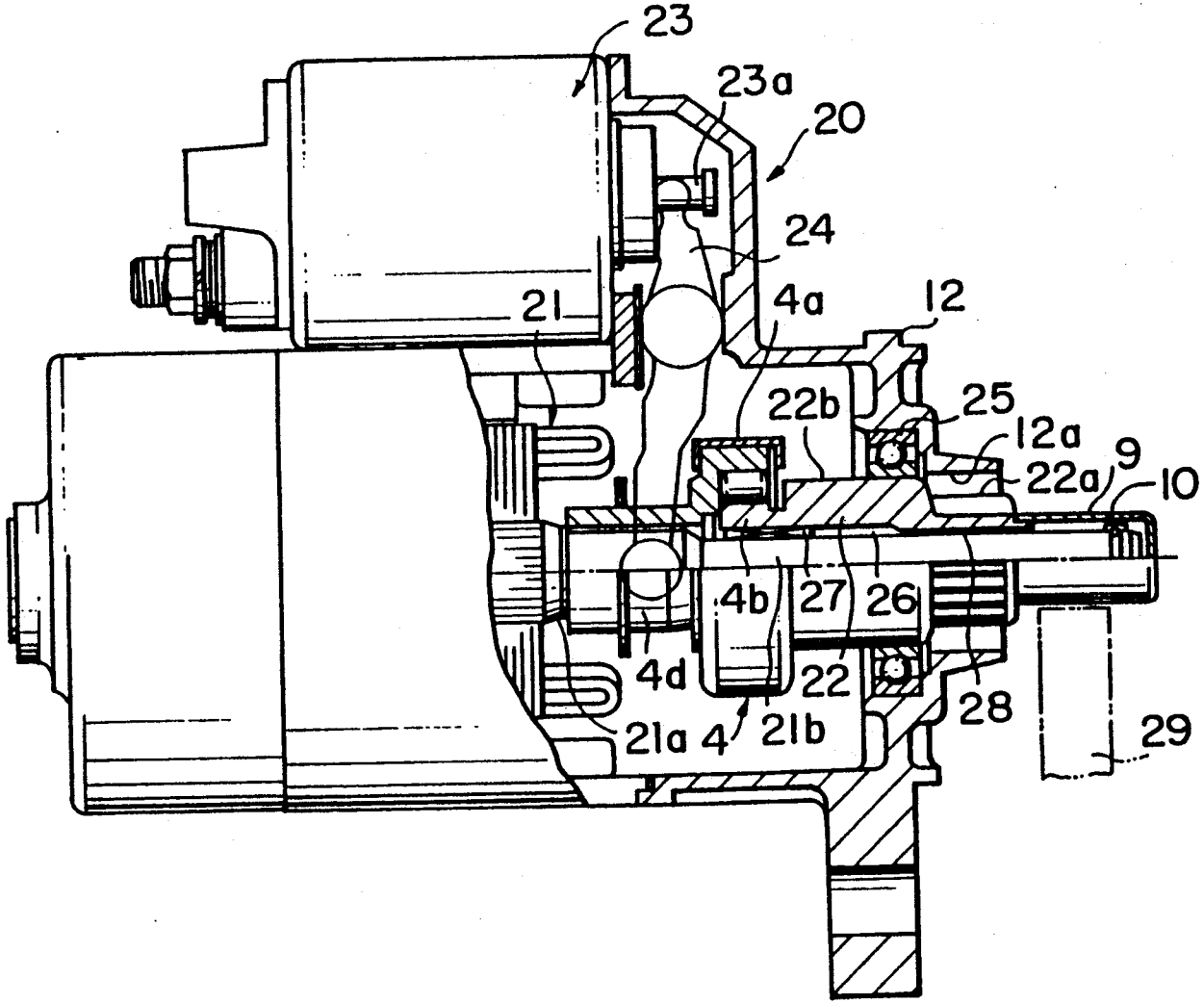
FIG. 1 is a sectional side view of an engine starter motor of one embodiment of the present invention.

In FIG. 1, an engine starter motor 20 comprises a d.c. motor 21 having an armature rotary shaft 21*a* including an output rotary shaft 21*b* extending forward (to the right in FIG. 1). The output rotary shaft 21*b* projects outwardly from an opening 12*a* formed in the front housing 12. An over-running clutch unit 4 is mounted on the output rotary shaft 21*b*.

The over-running clutch unit 4 is axially slidably mounted on the output rotary shaft 21*b* with its tubular member 4*d* integral with the clutch outer member 4*a* in engagement with splines formed on the output rotary shaft 21*b*. Also, since the clutch inner member 4*b* is the rear end portion of a pinion movement member 22 slidably mounted to the output rotary shaft 21*b*, the tubular member 4*d*, the over-running clutch unit 4 and the pinion movement member 22 are slidably movable along the output rotary shaft 21*b* as one piece. The axially acting force at this time is provided by a shift lever 24 which is connected at its one end to a plunger 23*a* of a solenoid switch 23 mounted to the front housing 12 and engaged at its forked end with the tubular member 4*d*.

Since the rear end portion of the pinion movement member 22 has a function of the clutch inner member 4*b*, this rear end portion is referred to as a clutch inner portion. On the other hand, the front end portion of the pinion movement member 22 is a pinion portion having a pinion 22*a* having seven teeth on its outer circumferential surface. The portion of the pinion movement member 22 between the pinion portion and the clutch inner portion is a sliding support surface 22*b*, which is slidably supported by an inner race of a ball bearing 25 securely fitted to the front housing 12 at a position inside of the opening 12*a* formed in the front housing 12. The pinion movement member 22 has a large-diameter inner circumferential surface extending from the clutch inner member portion to the intermediate sliding support surface 22*b* to define a relatively large clearance 26 between it and the outer circumferential surface of the output rotary shaft 21*b*. Within the clearance 26 a bearing 27 supports the output rotary shaft 21*b* through the pinion movement member 22. The pinion 22*a* at the front end portion of the pinion movement member 22 has a smaller-diameter inner circumferential surface defining a clearance 28 between it and the outer circumferential surface of the output rotary shaft 21*b*. An engine ring gear 29 which is to be engaged by the pinion 22*a* is shown by a phantom line in FIG. 1.

Not all of the load applied to the pinion 22*a* is supported by the output rotary shaft 21*b*, but is received by the ball bearing 25, so that the output rotary shaft 21*b* can be made smaller in outer diameter than the conventional design. Also, no outer bearing is disposed as was the case in the conventional design and only a small clearance 28 is defined between the pinion 22*a* and the output rotary shaft 21*b*. Therefore, while the thickness of the dedendum of the pinion 22*a* is maintained, the number of the teeth is determined to be seven with the teeth of the Module equal to that of the conventional design, i.e., with the teeth of $M \leqq 2.75$ and preferably $M=2.54$.

As is apparent from the foregoing description, since the mechanical strength of the shaft and the pinion teeth at the dedendum can be ensured and the number of the teeth is seven, the structural problem is solved.

The problem in the engagement will now be discussed. In general, the contact ratio decreases when the number of the teeth of a smaller gear is decreased, and this has conventionally been a problem. However, according to the present invention, the above decrease in the contact ratio is cancelled out by increasing the contact ratio by decreasing the meshing pressure angle $\alpha b$ and by decreasing the addendum modification coefficient of the pinion, and by increasing the teeth height. Further, it is possible that the overall contact ratio is maintained or increased by arranging that the addendum circle of the engine ring gear does not substantially intrude even when an undercut 22*c* is formed about the dedendum due to a smaller addendum modification coefficient of the pinion.

Figure 2A:
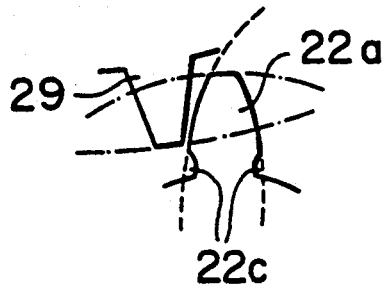
FIG. 2*a* is a view illustrating the detail of the meshing gears.
Figure 2B:
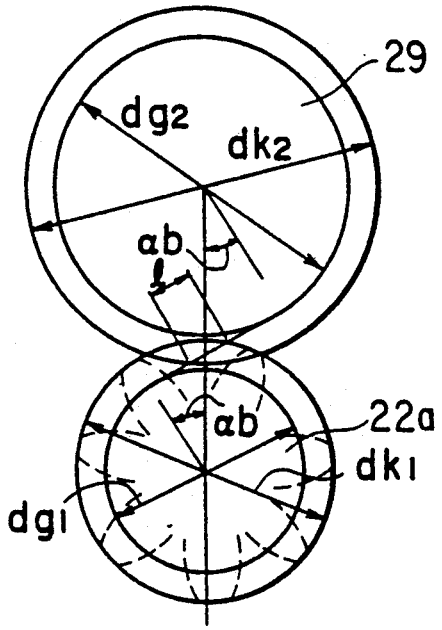
FIG. 2*b* is a diagram illustrating the meshing relationship of the gears.

More particularly, in FIG. 2*b*, the contacting portion of the gears moves within the engagement region 1 between the points at which the outer diameters $dk_1$ and $dk_2$ of two gears intersect the crossing tangential lines to the base circles $dg_1$ and $dg_2$ of the gears. The value obtained by dividing the length of the above engagement region 1 by the normal pitch of the gears is referred to as contact ratio. A smooth engagement between gears is difficult when the contact ratio is small. If the addendum modification coefficient of the smaller of the two gears is made small, the undercut 22*c* is formed, and if the undercut point intrudes into the above-mentioned engagement region, the engagement region is decreased and the contact ratio is disadvantageously decreased, so that this arrangement is seldom employed. However, upon designing a pinion of seven teeth, the value of Ded/M is selected small so that the cutter does not cut the involute surface to prevent the undercut, or even when the undercut 22*c* is formed as shown in FIG. 2*a*, the arrangement is such that the involute surface of the engine ring gear does not substantially intrude into the undercut point on the line of action. This was realized by selecting the cutter pressure angle of 20° and the addendum modification coefficient of equal to or less than 0.65. The preferable addendum modification coefficient is $0.45 \sim 0.60$. Also, when the teeth height is large, the addendum modification coefficient is large. Since a gear has a larger diameter with a smaller addendum modification coefficient when a predetermined constant addendum circle gear thickness is necessary, and the height of the teeth can be made large, a sufficient contact ratio can advantageously be obtained. From the above, it is apparent that a pinion of seven teeth can be realized without any particular problem. Thus, the electric motor unit can be made compact and light-weight by utilizing the pinion of seven teeth, and the solenoid switch for forwardly shifting and maintaining the pinion can also be made compact and light-weight.

Figure 3:
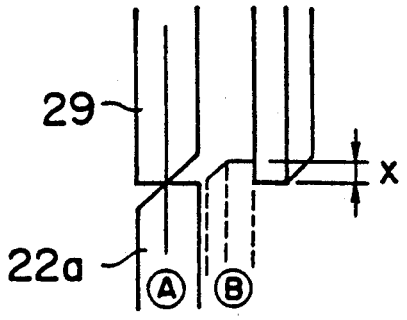
FIG. 3 is a diagram showing how the pinion and the engine ring gear mesh at the initial stage.

The description will now be made as to how the solenoid switch can be made compact and light-weight. FIG. 3 illustrates the initial state of the engagement between the pinion 22*a* and the engine ring gear 29. The time it takes for the pinion to rotate from position A to position B is expressed by:

$$t = \frac{(2\pi/Z)\cdot\alpha}{(2\pi/60)\cdot Ns} = \frac{60\,\alpha}{Ns\cdot Z} \qquad (1)$$

and the equation of movement in the axial direction of the pinion is:

$$F-f=(M/g)\cdot(d^2x/dt^2)$$

therefore, $$x = \frac{(F - f)g}{2M} \cdot t^2 \quad (2)$$

From equations (1) and (2), the following equation is obtained:

$$x = \frac{(F - f)g}{2M} \cdot \left(\frac{60\,\alpha}{Ns \cdot Z}\right)^2 \quad (3)$$

where, Z is the number of teeth of the pinion, $\alpha$ is a chamfer factor, Ns is the number of rotations of the electric motor, F is the spring force of a compression spring, f is the sliding resistance, M is the weight of the clutch (movement member), x is the initial engagement amount of the pinion relative to the engine ring gear and g is the gravitational acceleration.

Figure 5:
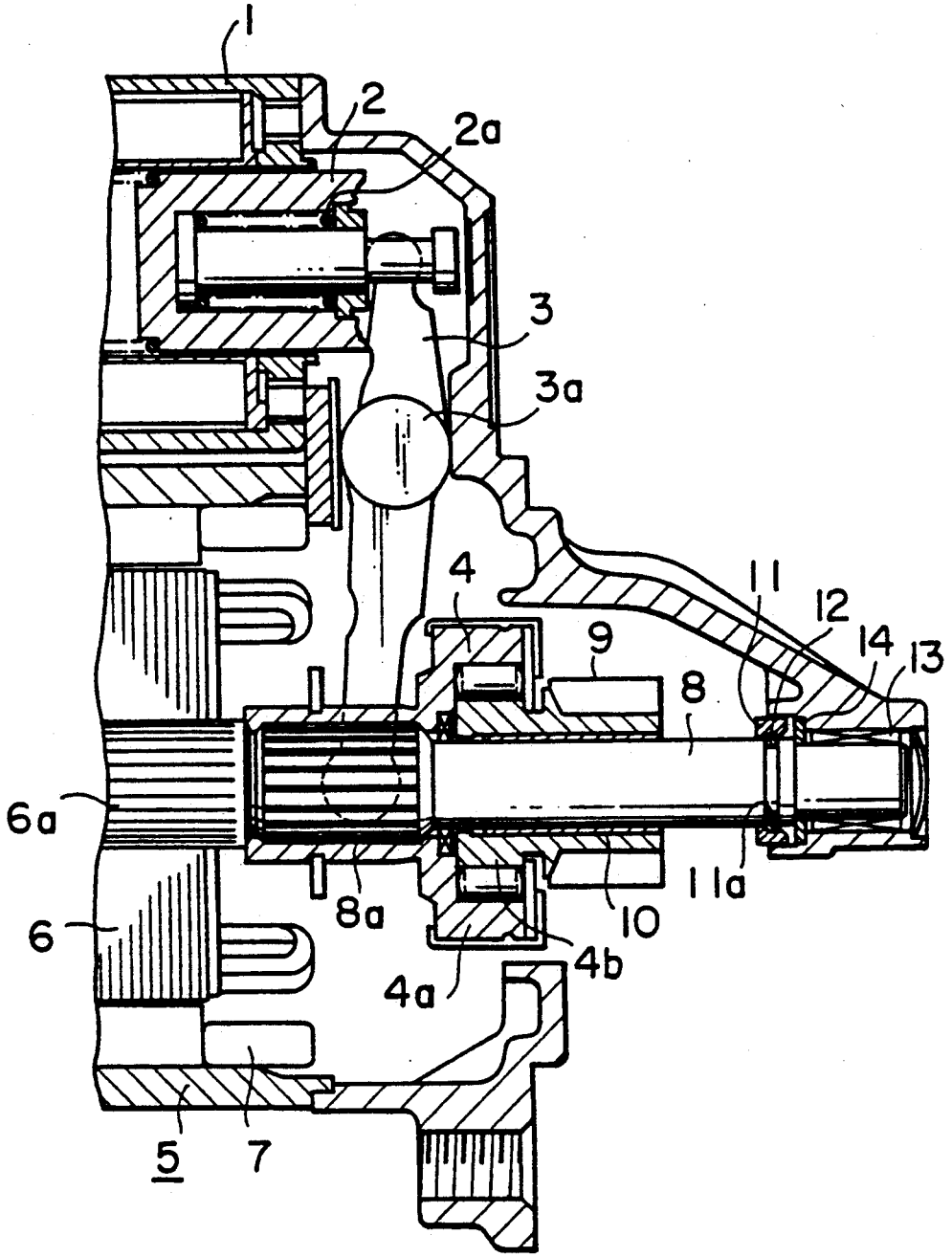
FIG. 5 PRIOR ART
FIG. 5 is sectional side view of a conventional engine starter motor.

If there is not a predetermined amount of x, a smooth engagement is difficult. Therefore, a predetermined spring force F of a compression spring (the spring 2a in the conventional starter shown in FIG. 5) is necessary, and an attractive force of the solenoid switch exceeding a predetermined amount of force taking the effects of the termperature increase of the coil of the solenoid switch and the wiring into effect, requires a large number of turns in the solenoid coil, thus making the solenoid switch large sized. Under these circumstances, when the teeth number Z in equation (3) is decreased with the same x, F can be made small, whereby a small-sized solenoid switch can be realized.

Figure 4:
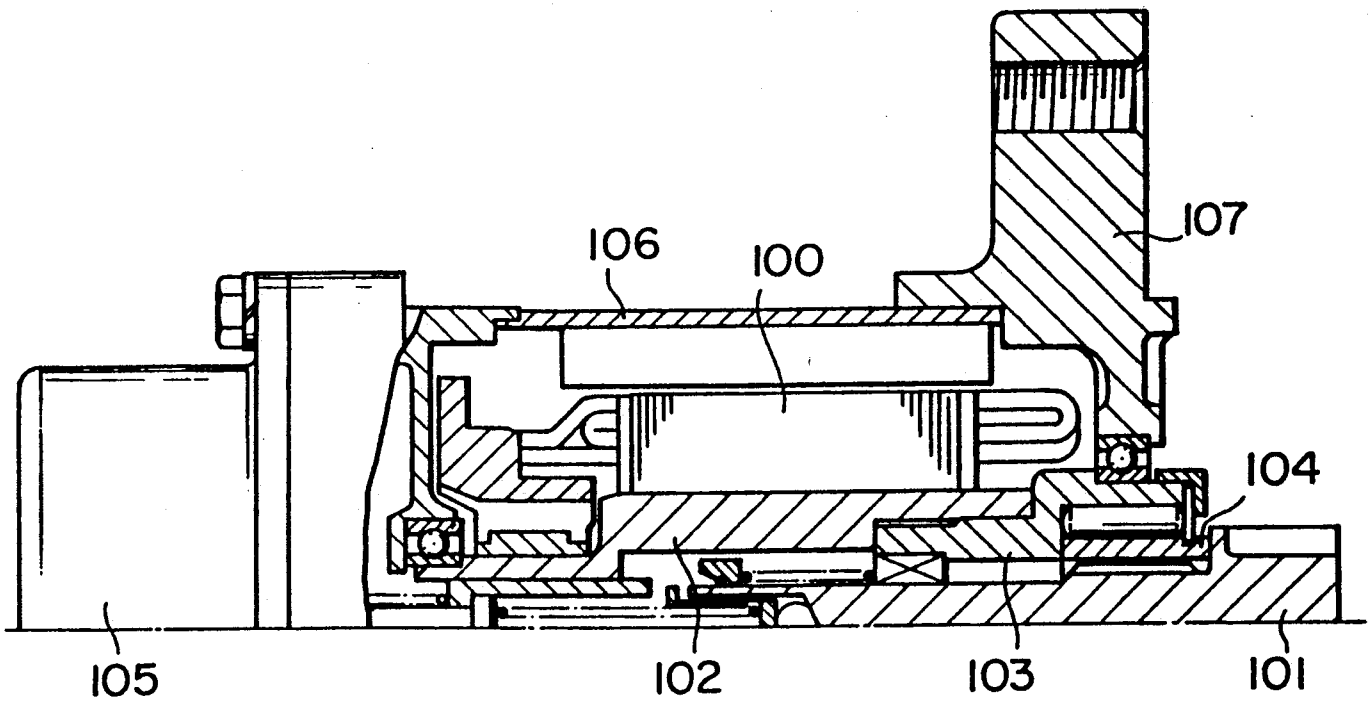
FIG. 4 is a sectional side view of one portion of the engine starter motor of another embodiment of the present invention.

While the over-hang type pinion has been described in the above embodiment, in which the output rotary shaft is thinner than that of the conventional design, the dedendum thickness of the pinion is not decreased and the number of teeth is seven, another arrangement is also possible as shown in FIG. 4, in which the pinion shaft 101 is arranged to slide within a clutch inner member 104 connected to a clutch outer member 103 of an over-running clutch to which the torque is transmitted from the armature rotary shaft 102, and in which seven teeth are formed on the front end of the pinion shaft 101. Also, while the solenoid switch 105 is disposed behind the electric motor 106 in FIG. 4, the solenoid switch may be disposed in parallel with the electric motor as in the previous embodiment of the present invention or the solenoid switch may be disposed in the outer circumferential portion of the pinion shaft. In FIG. 4, reference numeral 100 is an armature and 107 is a front housing.

Further, the engine starter of the present invention may comprise a speed reduction mechanism between the armature rotary shaft ond the output rotary shaft. Also, the dedendum modification coefficient has been explained as being decreased as means for reducing the operating pressure angle between the pinion and the engine ring gear, but a cutter of a small cutter pressure angle may be used instead.

As has been described, according to the present invention, the starter motor is of the over-hang-type and the number of pinion teeth is seven, so that the gear ratio between the pinion and the engine ring gear is increased, enabling the electric motor unit to be compact and light and enabling the solenoid switch to be compact, resulting in a compact and light engine starter motor which can be easily installed and mounted and dismounted in a packed engine compartment.

What is claimed is:

1. A compact and lightweight starter motor for an internal combustion engine, comprising: an axially displaceable pinion directly driven by the starter motor and directly engageable with a ring gear of an engine to start the engine by the motor, said pinion being disposed in an over-hanging relationship relative to a front housing of the motor, and the number of teeth of said pinion being seven, and a bearing disposed between an outermost portion of the front housing and the pinion for absorbing a majority of a load imposed upon the pinion upon the engagement thereof with the ring gear, wherein an addendum modification coefficient of the pinion is equal to or less than 0.65, and preferably between 0.45 and 0.60.

2. A starter motor according to claim 1, wherein a Module of the pinion is equal to or less than 2.75, and preferably about 2.54, said Module being the pitch between adjacent teeth of the pinion divided by pi.

* * * * *